US006016638A

United States Patent [19]

Bernard et al.

[11] Patent Number: 6,016,638

[45] Date of Patent: Jan. 25, 2000

[54] FOLDER/ INSERTER HAVING OPTIMIZED DOCUMENT PATHS

[75] Inventors: Emmanuel Bernard, Sannois; Dominique Mazeiller, La Frette, both of France

[73] Assignee: Neopost Industrie, Bagneux, France

[21] Appl. No.: 09/173,693

[22] Filed: Oct. 16, 1998

[30] Foreign Application Priority Data

Oct. 17, 1997 [FR] France ..... 9713053

[51] Int. Cl.[7] ..... B65B 5/04; B65B 63/04

[52] U.S. Cl. ..... 53/117; 53/201; 53/206; 53/284.3; 53/569

[58] Field of Search ..... 53/55, 117, 201, 53/131.4, 206, 284.3, 381.5, 569; 493/216

[56] References Cited

U.S. PATENT DOCUMENTS 4,924,652 5/1990 Krasuski et al. ..... 53/117
5,042,232 8/1991 Orsinger ..... 53/284.3
5,555,703 9/1996 Gombault et al. ..... 53/284.3

FOREIGN PATENT DOCUMENTS 0 352 692 A1 1/1990 European Pat. Off. .
0 700 7974 3/1996 European Pat. Off. .
WO 97/28972 8/1997 WIPO .

*Primary Examiner*—John Sipos
*Attorney, Agent, or Firm*—Sughrue, Mion, Zinn, Macpeak & Seas, PLLC

[57] ABSTRACT

A folder and/or inserter machine of the type comprising a first path coupled to a document inlet and feeding a folder module, a second path coupled to an empty-envelope inlet and feeding an inserter module itself coupled to the folder module, a third path coupled to an outlet for stuffed and closed envelope and to the inserter module, and a fourth path coupled to an advertising leaflet and/or reply envelope inlet and feeding the inserter module via the folder module, an envelope and document main inlet further being coupled via a switching module firstly to the first document path and secondly to an alternative empty-envelope path.

10 Claims, 2 Drawing Sheets

FOLDER/ INSERTER HAVING OPTIMIZED DOCUMENT PATHS

TECHNICAL FIELD

The present invention relates to the field of handling and conveying mail. More particularly, it relates to a folder/inserter designed to fold sheets for posting such as documents, reply envelopes, or advertising leaflets, and to put them into envelopes.

PRIOR ART

Document folders/inserters are industrial-scale machines that are well known in the art. Patent EP 352 292 and Patent Application FR 96 162279 filed in the Applicant's name show two examples of such machines. Unfortunately, the architecture of those machines is relatively complex because, to convey the envelopes and the various types of sheet constituted by the documents themselves but also by additional documents such as specific information dockets, advertising leaflets, or reply envelopes, said architecture must include numerous conveyor paths which, because they cross over one another, suffer from unavoidable risks of jamming and from limited operating throughput due to inevitable waiting periods in the cross-over zone. In addition, said architecture is ill-suited to use with a postage meter or franking machine making use of a general-purpose digital printer. Coupling the printer to the folder is then particularly critical.

OBJECTS AND DEFINITION OF THE INVENTION

An object of the present invention is to remedy that drawback by providing a folder and/or inserter machine that is specially adapted to being used with a general-purpose printer, and that also offers increased reliability and improved performance. In spite of this adaptation, another object of the invention is to enable the machine to be used as a conventional machine, thereby increasing operating flexibility.

These objects are achieved by a folder and/or inserter machine of the type comprising a first path coupled to a document inlet and feeding a folder module, a second path coupled to an empty-envelope inlet and feeding an inserter module itself coupled to the folder module, a third path coupled to an outlet for stuffed and closed envelopes and to the inserter module, and a fourth path coupled to an advertising leaflet and/or reply envelope inlet and feeding the inserter module via the folder module, said machine further comprising an envelope and document main inlet coupled via a switching module firstly to the first document path and secondly to an alternative empty-envelope path.

In a preferred embodiment of the invention, the envelope and document main inlet is designed to co-operate with the outlet of a general-purpose printer that can deliver printed envelopes and/or printed documents. Thus, it is possible to implement a complete mail-preparation system that offers particularly high performance.

Preferably, the envelope and document main inlet is connected to the first document path substantially downstream from the document inlet. Similarly, the alternative path passes through a reorientation module for reorienting the envelope so that it can be fed into the inserter module. The alternative path is preferably connected to the empty-envelope second path substantially downstream from the empty-envelope inlet after it has passed through the reorientation module. Advantageously, the first path for conveying the documents follows a substantially rectilinear trajectory, and the fourth path for conveying advertising leaflets/reply envelopes follows a substantially rectilinear trajectory aligned with the inlet of the inserter module.

Similarly, the document first path acts as a document accumulator tray when a plurality of documents are to be inserted into an envelope.

With the structure of the invention, the second path for conveying empty envelopes does not cross the first path for conveying documents. Thus, the reliability of the resulting machine is increased due to the reduction in jamming that previously resulted from the paths for conveying sheets for posting crossing over one another.

BRIEF DESCRIPTION OF THE DRAWINGS

Other characteristics and advantages of the present invention appear more clearly from the following description given by way of non-limiting example and with reference to the accompanying drawings, in which.

DETAILED DESCRIPTION OF PREFERRED EMBODIMENTS

Figure 1:
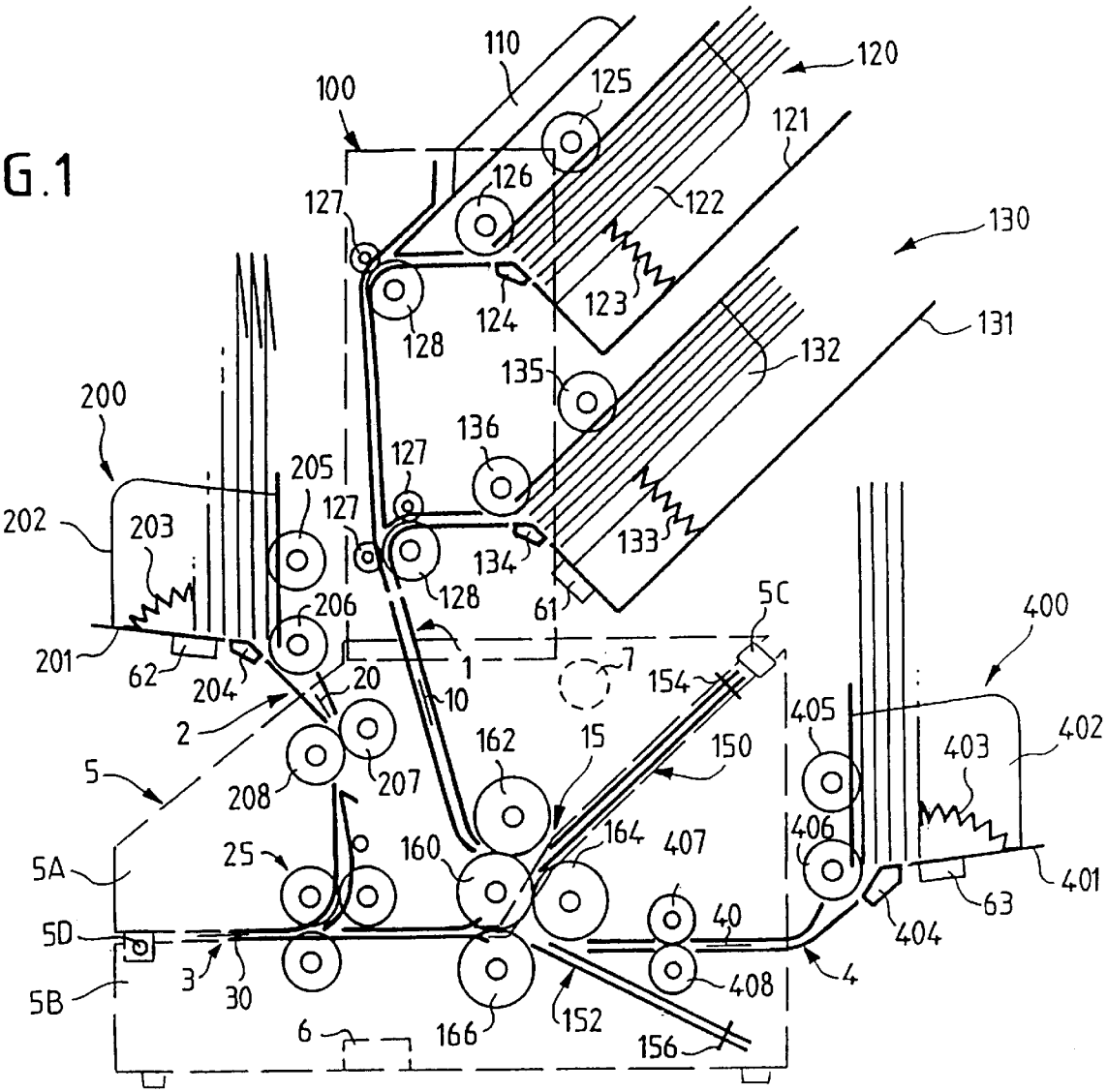
FIG. 1 is a very diagrammatic view of a first embodiment of a folder and/or inserter machine of the invention.
Figure 2:
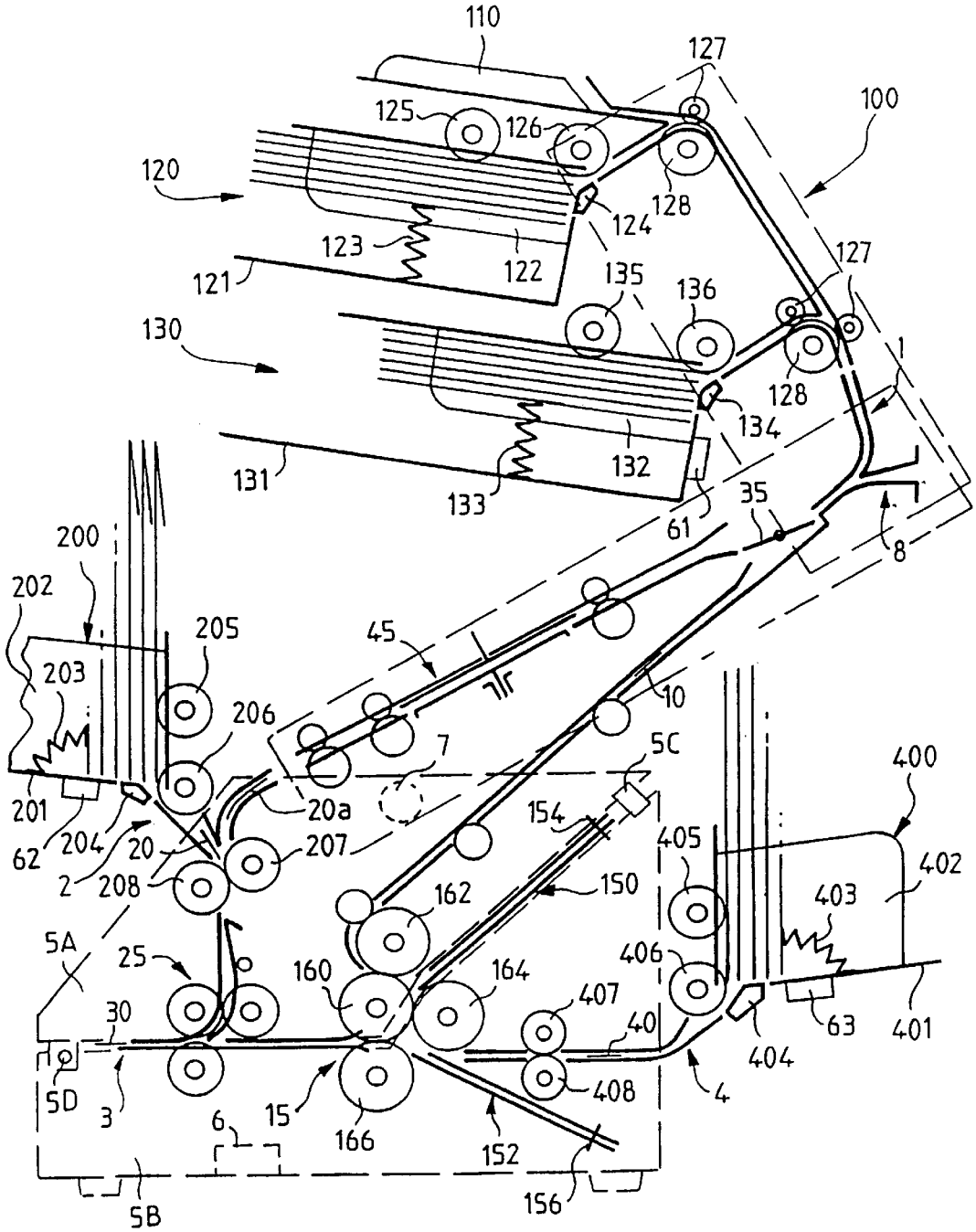
FIG. 2 is a diagrammatic view of a second preferred embodiment of such a machine.

As shown in FIGS. 1 and 2, a folder and inserter machine of the invention serves to fold sheets for posting, such as documents, advertising leaflets, and reply envelopes, and to put them into envelopes, preferably as the sheets are being produced. It is part of the equipment of a secretarial workstation where it constitutes one of the machines available to a person working at said workstation. The machine merely stands on the work surface of the workstation and access to it is easy, in particular access for feeding in sheets that said person is to put into envelopes.

The machine has a sheet inlet 1 situated at the base of a document main feeder 100 advantageously provided with a manual loading slot 110 for feeding in from one to five sheets, and two loading magazines (or trays) 120, 130, an empty-envelope inlet 2 situated at the base of an envelope secondary feeder 200 provided with a magazine of empty envelopes, a leaflet inlet 4 situated at the base of an auxiliary feeder 400 provided with a magazine of advertising leaflets or of reply envelopes, and an outlet 3 for envelopes that have been stuffed and closed. The various structural elements are formed on a machine structure 5 which is itself formed in two portions, namely an upper structure 5A and a lower structure 5B. The upper structure has its bottom face open and is hinge-mounted on the lower structure which has its top face open, so that the upper structure pivots about a pin 5D advantageously carried by the upper structure, and preferably at the front thereof. The upper structure 5A is also locked to the lower structure 5B which it then closes by known locking/unlocking means 5C preferably disposed at the rear of said upper structure. The empty envelopes are loaded in bundles into the magazine 200. Similarly, the advertising leaflets or the reply envelopes are loaded in bundles just as easily into the magazine 400. The stuffed and closed envelopes are made available at the outlet 3.

In a first embodiment of the invention shown in FIG. 1, the sheet inlet 1 and the empty-envelope magazine 200 are defined on the top wall of the upper structure 5A, with the inlet 1 being closer to the back than the empty-envelope inlet 2 (e.g. the inlet 2 is on the front of the machine and the inlet 1 is on its top). The advertising leaflet/reply envelope magazine 400 is defined behind the sheet inlet 1 on the back of the machine and substantially where the upper structure 5A and the lower structure 5B meet, and the stuffed and closed envelope outlet 3 is defined at the bottom, and at the front of the lower structure SB, in front of the empty-envelope inlet.

The sheet inlet 1 corresponds to a sheet path 10 in the machine, which path feeds a folder module 15. The folder module 15 preferably has two fold or buckle chutes, namely an upper chute 150 serving to form a first fold, and a lower chute 152 serving to form a second fold, the chutes being associated with four fold rollers 160 to 166 including a drive roller 160. The path 10 defines the trajectory of a sheet between the inlet 1 and the folder module 15. It forms a substantially rectilinear line terminated by a bend guiding the sheet from the inlet 1 (on the top of the machine) to a middle portion of the upper structure 5A, so as to feed the folder module 15, part of which is mounted in a rear middle portion of the structure 5A, and part of which is mounted in a rear middle portion of the structure 5B. At the end of the path 10, and during the folding performed by the folder module, said folder module 15 causes the trajectory of the sheet to be deflected back towards the sheet outlet 3.

The empty-envelope inlet 2 corresponds to an empty-envelope path 20 in the machine. This path 20 does not intersect the sheet path 10 at any point along its route through the machine and it leads to a front middle portion of the machine. This path defines the trajectory of the empty envelopes from the inlet 2 to an inserter module 25. It also forms a substantially rectilinear line terminating in a bend guiding the envelopes into the inserter module. It is provided with means (not shown) for opening the flaps of empty envelopes.

The leaflet inlet 4 corresponds to an advertising leaflet or reply envelope path 40 in the machine, which path brings the leaflets to a zone in which the document second fold is formed in the folder module 15, and more precisely to the inlet of the second fold chute 152. The path follows a trajectory that is substantially rectilinear and that is aligned with the inlet of the inserter module 25.

The closed-envelope outlet 3 corresponds to a stuffed-envelope path 30. This path 30 is substantially linear and it extends between the upper structure 5A and the lower structure 5D from the front portion of the machine to the front middle portion of the machine, and it is aligned with the folded sheet outlet of the folder module 15 and substantially with the leaflet path 40. The path 30 is conventionally equipped with various modules which come apart when the upper structure 5A is opened away from the lower structure 5B, and which are modules such as a module for stuffing the sheets into empty envelopes (inserter module 25), a module for moistening the flaps, and a module for folding and closing the flaps (the latter two modules not being shown).

A control circuit 6 defines the commands of the machine during a control cycle, if necessary in co-operation with interface circuits 61, 62, 63 specific to the main feeder 100, to the secondary feeder 200, and to the auxiliary feeder 400.

The feed magazines may, for example, be made of welded sheet metal, and each of them conventionally comprises two side feed guides 122, 132, 202, 402 and a moving rear presser 123, 133, 203, 403 on a support plate 121, 131, 201, 401, the side feed guides being self-centering (sliding in synchronized manner by means of a rack-and-pinion mechanism (not shown). On a portion of its end wall, the support plate is provided with a separator/selector feed 124, 134, 204, 404 constituted by a pad covered with a rough covering for separating/selecting the various kinds of sheet (documents, empty envelopes, advertising leaflets, or reply envelopes) extracted from the corresponding magazine. The sheets are driven by at least one wheel, and preferably two wheels 125 & 126, 135 & 136, 205 & 206, and 405 & 406 for extracting sheets, which wheels are driven by a control motor 7 of the machine via a set of drive sprockets (not shown).

Naturally, various sensors (not shown) are provided for ensuring, in conventional manner, that the various feeders 100, 200, 400 operate correctly, and in particular for detecting that a sheet has entered a conveyor path 10, 20, 40 (end of selection by the separator/selector feed), for detecting that folds have been formed (at the fold abutments of the first and second chutes), and for detecting that sheets (documents, empty envelopes, advertising leaflets, or reply envelopes) are present in the various magazines, etc.

The two-chute folder module 15 and the modules for opening the flaps, for moistening the flaps and for closing the envelopes are described in detail in the Applicant's Patent EP 0 352 692, for example.

Operation of the first embodiment of the folder and/or inserter machine of the invention is described with reference to putting documents accompanied by advertising leaflets into envelopes.

It should be noted firstly that access to the magazines 200 and 400 is easy, since the empty envelopes and the leaflets are stored vertically. Bundles of leaflets can be put in place merely by moving back the rear presser. The same applies to the document magazines which are advantageously situated on the top of the machine.

During a first stage, the advertising leaflet (or the reply envelope) is withdrawn from the magazine by the wheels 405, 406 for extracting sheets, and, after selection by the separator/selector feed 404, it is driven between conveyor wheels and backing wheels 407, 408 along the path 40 until it arrives at the roller 164 of the folder module 15, where it remains in a standby position (a detector (not shown) makes it possible to determine this position and to interrupt (declutch) the drive means 10 for driving the leaflet). Naturally, so as to avoid excessively reducing the throughput of the machine, the first operating stage is preferably performed in parallel with the other operating stages of the machine. The second operating stage is performed differently depending on whether the leaflet is to be inserted on its own into an empty envelope or together with other documents. When it is inserted on its own, the leaflet is put back in motion when the empty envelope extracted from the magazine 200 by the extractor wheels 205, 206 and by the separator/selector feed 204 is driven by the pressure wheels and backing wheels 207, 208 along the path 20 until it reaches the inserter module 25. When the leaflet is inserted together with a document, the document, which arrives at the folder module 15 from the path 10 after it has been extracted from the magazine 120 (or from the magazine 130) by the extractor wheels 125, 126 (or 135, 136) and by the separator/selector feed 124 (134), is driven (via the conveyor wheels and backing wheels 127, 128) by the rollers 160, 162 into the first fold chute 150, then, after forming a buckle (resulting from the sheet coming into contact with the fold abutment 154 of the first chute), it is driven by the rollers 160, 164 into the second fold chute 152 until it comes into contact with the second fold abutment 156 of the second chute. Whereupon (at the end of folding), the leaflet is put in motion again and is propelled into the folding zone so as to driven by the rollers 160, 166 to the inserter module 25 at the beginning of the path 30. Naturally, the above-described process may likewise apply to a document from the feed slot 110. It should be noted that the abutments 154, 156 are adjustable by being moved in translation along each chute, so as to select the positions of the first and second folds.

FIG. 2 shows a second preferred embodiment of a folder and/or inserter machine of the invention as specially adapted for operating from a general-purpose digital printer such as a laser printer or an ink jet printer. The machine comprises essentially the same elements (designated by the same references) as those described above with reference to FIG. 1, which enables it to operate as a conventional machine, i.e. from a tray for feeding in empty envelopes. But, in addition, it is provided with specific additional means enabling it to co-operate with a general-purpose printer.

Thus, its essential elements such as the folder module 15 and the inserter module 25 and the other abovementioned modules can be seen, as can the three feeders 100, 200, 400 for feeding in documents, empty envelopes, and leaflets respectively. The leaflet path 40 between the advertising leaflet/reply envelope magazine 400 and the folder module 15 remains unchanged, as does the path 20 between the empty-envelope magazine 200 and the inserter module 25. However, said path 20 constitutes merely an alternative path for conveying empty envelopes. A second empty-envelope path 20a is provided for bringing the envelopes from an envelope and document main inlet 8 to the inserter module 25, which main inlet is coupled directly to a general-purpose printer outlet. The path 20*a* is substantially rectilinear between the main inlet 8 and the empty-envelope inlet 2 which it joins via a bend downstream from the empty-envelope inlet 2 at the conveyor wheels and backing wheels 207, 208. And, as described above, the document path 10 conveys the documents 120 from the manual feed slot 110 or from the document magazines 120, 130 directly to the folder module 15 without crossing the envelope paths 20, 20*a*. However, the document path 10 is provided with an alternative document inlet constituted by the envelope and document main inlet 8 from the general-purpose printer, said main inlet joining the document path 10 downstream from the document inlet 1.

To enable the empty envelopes and the documents output by the printer to be conveyed along their respective conveyor paths 20*a*, 10, the main inlet 8 is immediately followed by a switching module 35 controlled from the control circuit 6. The switching module also receives the document inlet 1. It should be noted that the alternative envelope path 20*a* is provided with a device 45 for reorienting envelopes such as the device described in the Applicant's Patent Application FR 97 11797, for example. The orientation of the envelopes as output by the printer can be significantly different depending on the type of printer in question, whereas the inserter module 25 can receive only envelopes that are presented crosswise. It is therefore necessary to provide a module that changes the orientation of the envelopes delivered by the printer, whenever such a change is required. Like the switching module 35, the reorientation module 45 is under the control of the control circuit 6.

Operation of this preferred embodiment of the folder and/or inserter machine comprises two distinct modes. In a first mode, it operates identically to the conventional machine as explained above with reference to FIG. 1. In this mode, the switching module 35 is in a first position which blocks off the alternative empty-envelope path 20*a*. The documents output by the feeder 100 are then directed directly to the folder module 15, then, after being folded, they are inserted into envelopes delivered by the feeder 200 at the inserter module 25. If necessary, a leaflet is also inserted into the envelope. After insertion, the resulting stuffed enveloped is closed and directed to the outlet 3.

In a second operating mode, the switching module 35 makes it possible to activate the alternative path 20*a* selectively, and the empty-envelope magazine 200 is then no longer used. Two options for using the folder and/or inserter machine are then possible, depending on the software configuration of the printer. In a first variant, the printer prints the empty envelopes only. In which case, an envelope that is output by the printer enters the machine immediately via its main inlet 8. Since the switching module 35 is positioned in a second position which unblocks the alternative empty-envelope path 20*a* (the document path is then blocked off), the envelope is driven to the reorientation module 45, where it is optionally reoriented, and then to the inserter module 25 (by means in particular of conveyor wheels and backing wheels 207, 208). After the envelope has gone past the switching module 35, said switching module is repositioned in its first position, thereby unblocking the document path 10 so as to receive the document(s) to be inserted into the envelope and delivered by the various magazines of the feeder 100 at the document inlet 1. The documents are brought to the folder module 15, and then, after being folded, they are inserted into the envelope. If necessary, a leaflet may also be inserted into the envelope from the leaflet magazine 400. After insertion, the resulting stuffed envelope is closed and directed to the outlet 3 of the machine. In a second variant, the printer prints not only the envelope but also the documents, using a method such as the method described in the Applicant's Application FR 97 11798. In that method, the envelope is output first from the printer and, since the switching module is positioned in its second position, the envelope follows the path 20*a* from the main inlet 8 to the inserter module 25 as described above. In parallel, as soon as the envelope has passed through the switching module, said switching module is positioned in the first position, and the documents can then be inserted into the document path 10 which also acts as an accumulator tray when a plurality of documents are to be inserted into the envelope. The documents are then folded together and, at the outlet of the folder module, they are directed to the inserter module 25 to be inserted into the envelope that is waiting in the module. As above, a leaflet may also be inserted into the envelope which, once stuffed, is closed and directed to the outlet 3.

With the folder and/or inserter machine of the invention, it is possible to cause all of the conveyor paths to converge in a middle zone of the machine without them crossing over one another, and, in addition, while implementing paths that are particularly short (in particular in the conventional version). The sheets are thus moved more simply and much faster, thereby improving the performance of the machine and increasing its reliability while retaining its initial operating flexibility.

We claim:

1. A folder and inserter machine of the type comprising a first path coupled to a document inlet and feeding a folder module, a second path coupled to an empty-envelope inlet and feeding an inserter module itself coupled to the folder module, a third path coupled to an outlet for stuffed and closed envelopes and to the inserter module, and a fourth path coupled to an advertising leaflet and/or reply envelope inlet and feeding the inserter module via the folder module, said machine further comprising an envelope and document main inlet coupled via a switching module firstly to the first document path and secondly to a fifth path connected to said insert module defining an alternate empty-envelope path to selectively feed from said main inlet documents to said first path or empty envelopes to said alternative fifth path.

2. A folder and inserter machine according to claim 1, wherein the envelope and document main inlet is connected to the first document path substantially downstream from the document inlet.

3. A folder and inserter machine according to claim 1, wherein the alternative path passes through a reorientation module for reorienting the envelope so that it can be fed into the inserter module.

4. A folder and inserter machine according to claim 3, wherein the alternative path is connected to inserter module through the empty-envelope second path substantially downstream from the empty-envelope inlet after it has passed through the reorientation module.

5. A folder and inserter machine according to claim 1, wherein the first path for conveying the documents follows a substantially rectilinear trajectory.

6. A folder and inserter machine according to claim 1, wherein the fourth path for conveying advertising leaflets/reply envelopes follows a substantially rectilinear trajectory aligned with the inlet of the inserter module.

7. A folder and inserter machine according to claim 1, wherein the document first path acts as a document accumulator tray when a plurality of documents are to be inserted into an envelope.

8. A folder and inserter machine according to claim 1, wherein the second path for conveying empty envelopes does not cross the first path for conveying documents.

9. A folder and inserter machine according to claim 8, wherein the document inlet is disposed behind the empty-envelope inlet, and the stuffed and closed envelope outlet is disposed in front of the empty-envelope inlet.

10. A folder and inserter machine according to claim 1, wherein the envelope and document main inlet is designed to co-operate with the outlet of a general-purpose printer that can deliver printed envelopes and/or printed documents.

* * * * *